US008517334B2

(12) United States Patent
Shiao et al.

(10) Patent No.: US 8,517,334 B2
(45) Date of Patent: Aug. 27, 2013

(54) ELECTROMAGNETIC VALVE MECHANISM

(75) Inventors: Yaojung Shiao, Taipei (TW); Yi-Jie Zeng, Zhubei (TW)

(73) Assignee: National Taipei University of Technology (TW)

( * ) Notice: Subject to any disclaimer, the term of this patent is extended or adjusted under 35 U.S.C. 154(b) by 92 days.

(21) Appl. No.: 13/367,528

(22) Filed: Feb. 7, 2012

(65) Prior Publication Data

US 2013/0062543 A1 Mar. 14, 2013

(30) Foreign Application Priority Data

Sep. 14, 2011 (TW) ..... 100133057 A

(51) Int. Cl.
*F16K 31/08* (2006.01)

(52) U.S. Cl.
USPC ..... 251/65; 251/129.09; 251/129.1; 123/90.11

(58) Field of Classification Search
USPC ..... 251/65, 129.09, 129.1; 123/90.11; 361/144, 152
See application file for complete search history.

(56) References Cited

U.S. PATENT DOCUMENTS 4,749,167 A * 6/1988 Gottschall ..... 251/65
4,829,947 A * 5/1989 Lequesne ..... 123/90.11
4,831,973 A * 5/1989 Richeson, Jr. ..... 123/90.11
4,883,025 A * 11/1989 Richeson, Jr. ..... 123/90.11
5,069,422 A * 12/1991 Kawamura ..... 251/129.1
6,526,928 B2 * 3/2003 Bauer et al. ..... 123/90.11
6,581,556 B2 * 6/2003 Kim ..... 123/90.11
7,047,919 B2 * 5/2006 Morin et al. ..... 123/90.11
7,128,032 B2 * 10/2006 Froeschle et al. ..... 123/90.11
7,252,053 B2 * 8/2007 Froeschle et al. ..... 123/90.11
2005/0188928 A1 * 9/2005 Sedda et al. ..... 123/90.11
2007/0025046 A1 * 2/2007 Maerky et al. ..... 361/160
2007/0044741 A1 * 3/2007 Daniel ..... 123/90.11
2010/0163766 A1 * 7/2010 Alvarez et al. ..... 251/65
2013/0056661 A1 * 3/2013 Tang et al. ..... 251/129.15

* cited by examiner

*Primary Examiner* — John K Fristoe, Jr.
*Assistant Examiner* — Umashankar Venkatesan
(74) *Attorney, Agent, or Firm* — Schmeiser, Olsen & Watts, LLP

(57) ABSTRACT

An electromagnetic valve mechanism includes a magnetizable block, an upper permanent magnet superposed on a top of the magnetizable block, a magnetizable upper cover superposed on an upper flat surface of the upper permanent magnet, a lower permanent magnet attached to a bottom of the magnetizable block, a magnetizable lower cover attached to a lower flat surface of the lower permanent magnet, an armature movably received in the magnetizable block, a magnetizable ring located around the armature, an electromagnetic coil unit wound around two opposite protrudent rods of the magnetizable ring, and a spring unit disposed around an armature stem and a valve stem. By adding the permanent magnets and using the electromagnetic coil unit to thereby form a bypassed forward secondary magnetic channel, the electromagnetic valve mechanism can achieve the purposes of lowered energy consumption, reduced overall mechanism volume, providing demagnetization-protection for permanent magnets, and enhanced performance.

7 Claims, 8 Drawing Sheets

(a)

(b)

ELECTROMAGNETIC VALVE MECHANISM

CROSS-REFERENCE TO RELATED APPLICATION

This non-provisional application claims priority under 35 U.S.C. §119(a) on Patent Application No(s). 100133057 filed in Taiwan, R.O.C. on Sep. 14, 2011, the entire contents of which are hereby incorporated by reference.

FIELD OF TECHNOLOGY

The present invention relates to an electromagnetic valve mechanism, and more particularly to an electromagnetic valve mechanism that provides the advantages of lowered energy consumption, reduced overall mechanism volume, demagnetization-protection for permanent magnets, and enhanced valve performance.

BACKGROUND

In the present time of pursuing fuel economy and fuel efficiency, one of the ways for effectively increasing the engine efficiency is to control the engine's valve timing. Electromagnetic valve mechanism has been developed to enable effective control of the valve timing. That is, the use of an electromagnetic valve mechanism in place of the conventional camshaft would bring the possibility of fully variable valve timing.

However, the conventional electromagnetic valve mechanisms have the following problems:

(1) Consuming relatively high energy: The conventional electromagnetic valve mechanism without permanent magnet requires additional energy to maintain the valve in a fully opened or a fully closed position, which results in consumption of extra energy.

(2) Requiring starting current: The armature in the conventional electromagnetic valve mechanisms is located at a middle position in a balanced state before the engine is started. Thus, a pilot current must be supplied for bringing the armature to the fully closed position before the engine is started. By doing this, a large quantity of energy will be consumed.

(3) Causing demagnetization of permanent magnet: While the conventional electromagnetic valve mechanism developed at a later stage is able to provide a force for maintaining the valve at the fully opened or fully closed position by applying a current to the electromagnetic coil for the same to produce a magnetic force opposite to and accordingly offsetting the force of the permanent magnet, so that the valve is released and can be actuated. However, with this design, the electromagnetic flux will pass through the permanent magnet in a reverse direction, which will cause demagnetization of the permanent magnet, resulting in lowered force of the permanent magnet.

(4) Causing uneven wear of valve: When the engine operates, the conventional cam-driven valves also rotate. During the rotation, the valve will contact with the valve seat to cause collision and wear. In addition, in the most of conventional electromagnetic valve mechanisms, the armature thereof is cubic in shape and therefore fails to rotate along with the rotating engine. This design not only causes uneven wear of the valve, but also the collision of the armature with the wall of the electromagnetic valve structure. As a result, the electromagnetic valve mechanism will become damaged after being used over a long time.

(5) Having a relatively large mechanism volume: To provide large magnetic force for moving the valve, the conventional electromagnetic valve mechanism includes a solenoid valve coil of a relatively large volume, which causes increased difficulty in mounting the large electromagnetic valve mechanism on top of the engine's cylinder head.

(6) Having a magnetizable block with relative small magnetic attraction to the armature before contacting with the latter: Due to the magnetic circuit design thereof, the conventional permanent-magnet electromagnetic valve mechanism has the problem of a relatively small magnetic attraction of the magnetizable block to the armature before the magnetizable block is in contact with the armature. Thus, in the event of any change in the system resistance, a system failure might occur.

(7) Having low system robustness and small variable operating ranges for parameters: In the event of changes in system parameters, such as demagnetization of the permanent magnet and degraded magnetic force lower than the initially designed magnetic force, the system would not be able to magnetically attract the armature and become failed without the ability of operating normally.

It is therefore desirable to develop an improved electromagnetic valve mechanism so as to achieve the purposes of lowered energy consumption, reduced overall mechanism volume, providing demagnetization-protection for permanent magnets, and enhanced valve performance.

SUMMARY

In view of the drawbacks in the conventional electromagnetic valve mechanisms, it is therefore tried by the inventor to develop an improved electromagnetic valve mechanism that has the advantages of lowered energy consumption, reduced overall mechanism volume, providing demagnetization-protection for permanent magnets, and enhanced valve performance.

A primary object of the present invention is to provide an electromagnetic valve mechanism, in which permanent magnets are added as an aid and an electromagnetic coil unit is used to thereby form a bypassed forward secondary magnetic channel in the electromagnetic valve mechanism, so as to achieve the effects of lowered energy consumption, reduced overall mechanism volume, providing demagnetization-protection for permanent magnets, and enhanced valve performance.

To achieve the above and other objects, the electromagnetic valve mechanism according to the present invention includes a magnetizable block, an upper permanent magnet, a magnetizable upper cover, a lower permanent magnet, a magnetizable lower cover, an armature, a magnetizable ring with two opposite protrudent rods, a valve, and a spring unit. The magnetizable block has a top and a bottom, and internally defines a chamber; and the magnetizable block is formed from a left and a right magnetizable block part, which are spaced from but face toward each other. The upper permanent magnet is superposed on the top of the magnetizable block, and has an upper flat surface; and the upper permanent magnet is formed from a left and a right upper permanent magnet, which are spaced from but face toward each other. The magnetizable upper cover is superposed on the upper flat surface of the upper permanent magnet. The lower permanent magnet is attached to the bottom of the magnetizable block, and has a lower flat surface; and the lower permanent magnet is formed from a left and a right lower permanent magnet, which are spaced from but face toward each other. The magnetizable lower cover is attached to the lower flat surface of the lower permanent magnet. The armature is movably received in the chamber in the magnetizable block, and includes an armature stem, which downward extends through the magnetizable lower cover to an outer side thereof to connect with a valve stem. The magnetizable ring with two opposite protrudent rods is located around the armature, and the two opposite protrudent rods are connected to the left and right magnetizable block parts, respectively. The electromagnetic coil unit includes a left and a right electromagnetic coil separately wound around the two opposite protrudent rods of the magnetizable ring. The valve is connected to a lower end of the valve stem. The spring unit is disposed around the armature stem and the valve stem with an upper and a lower end of the spring unit pressing against the magnetizable lower cover and a machine body, respectively.

By adding the permanent magnets as an aid and using the electromagnetic coil unit to thereby form a bypassed forward secondary magnetic channel, the electromagnetic valve mechanism according to the present invention can achieve the purposes of having lowered energy consumption, reduced overall mechanism volume, providing demagnetization-protection for permanent magnets, and enhanced valve performance.

BRIEF DESCRIPTION

The structure and the technical means adopted by the present invention to achieve the above and other objects can be best understood by referring to the following detailed description of the preferred embodiments and the accompanying drawings, wherein FIG. 1 is an exploded perspective view of an electromagnetic valve mechanism according to a first embodiment of the present invention;

Figure 4:
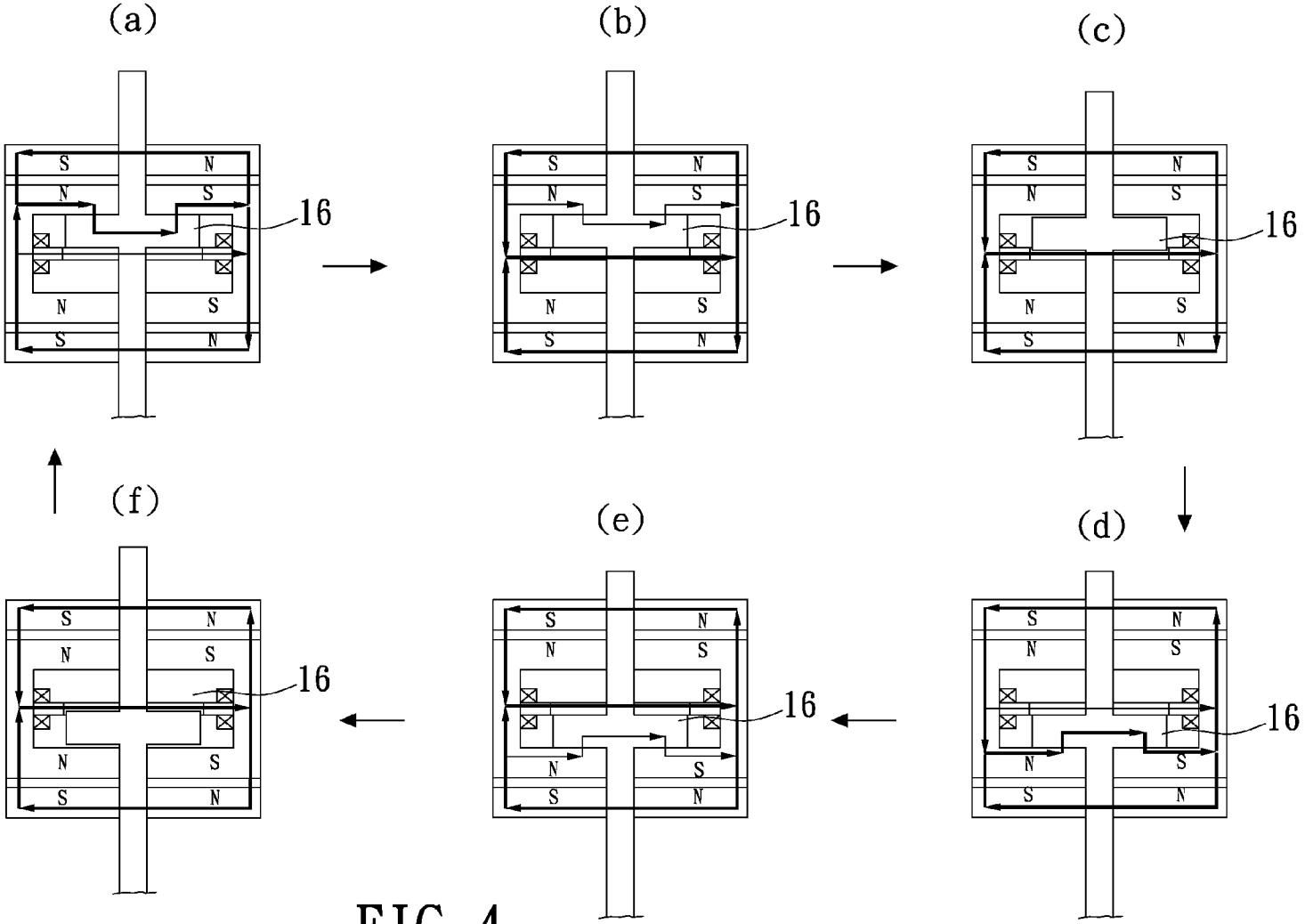
Figure 5:
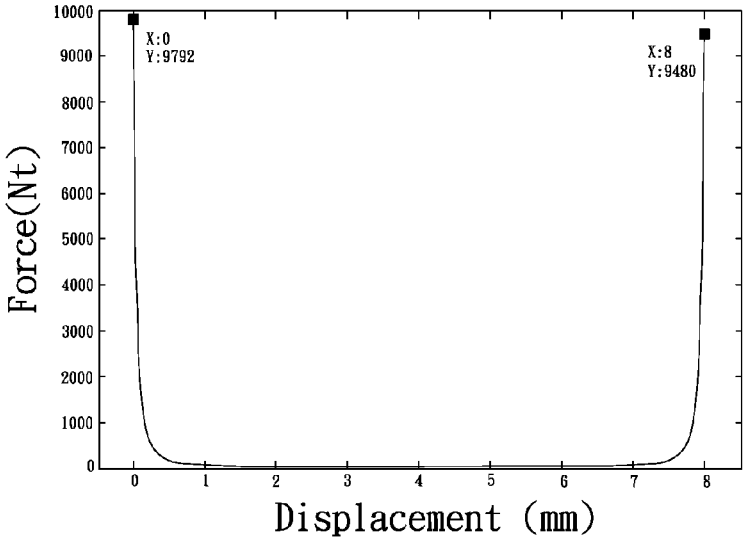
Figure 6:
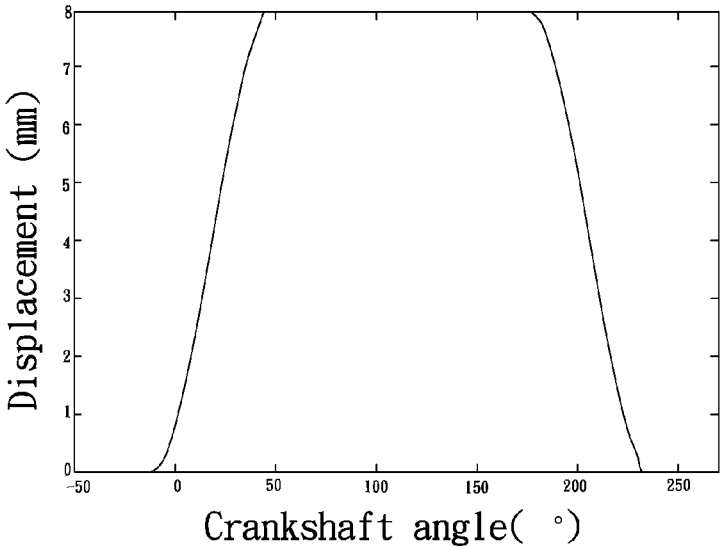
Figure 7:
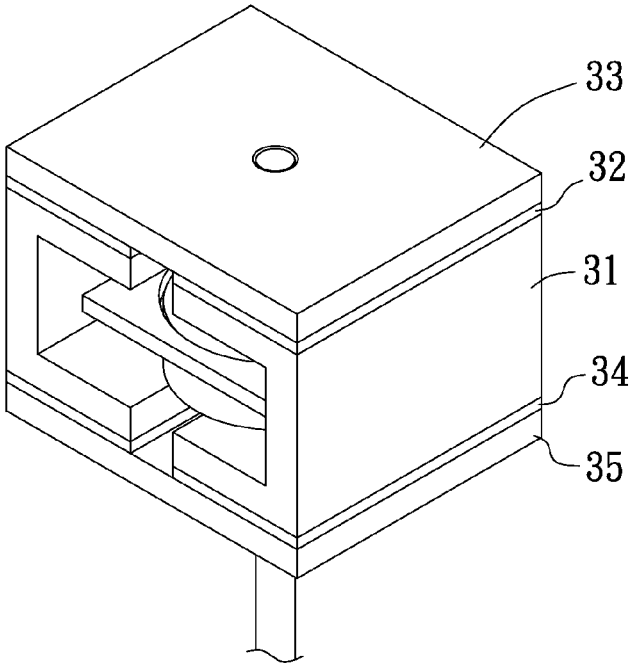
Figure 7:
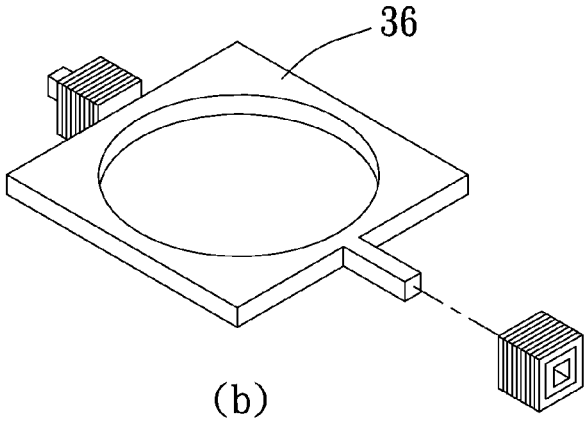
Figure 8:
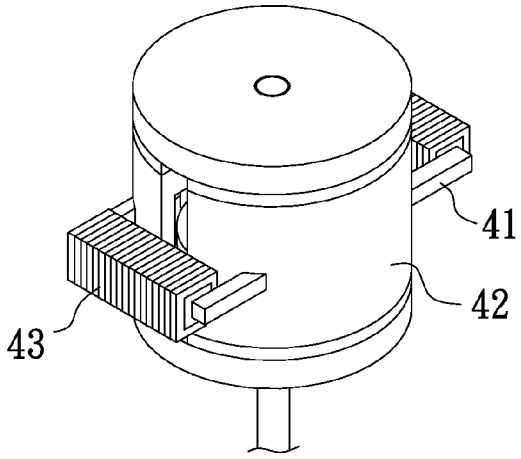
Figure 9:
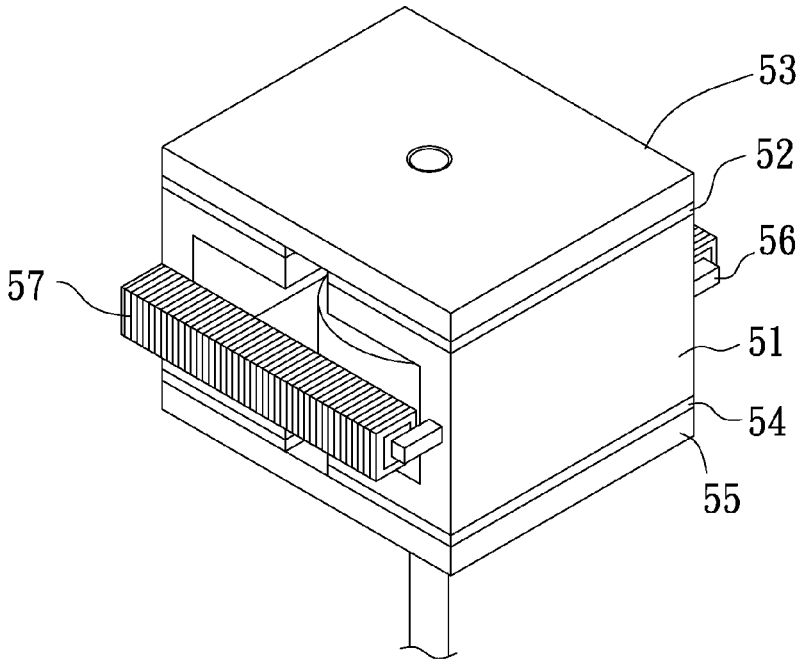
Figure 10:
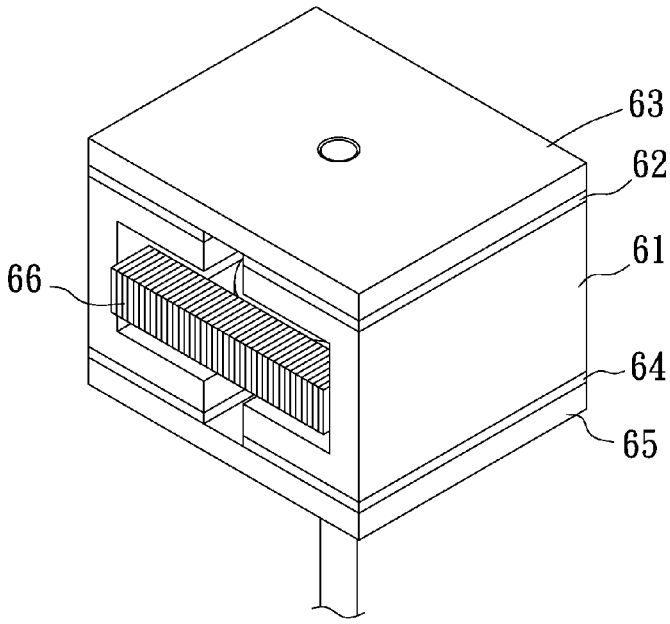
Figure 11:
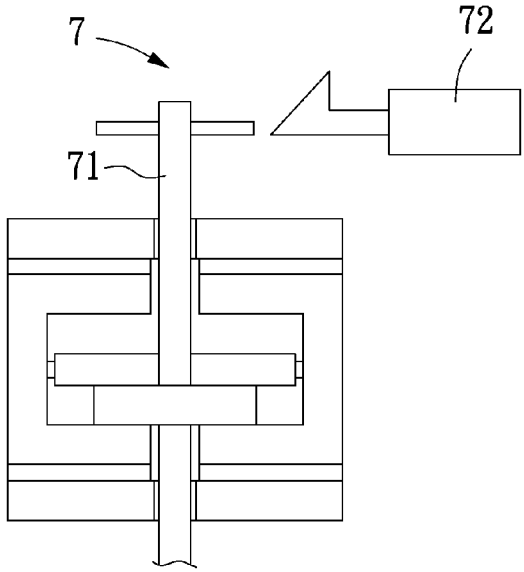

FIGS. 4(*a*)-(*f*) show the actuation and operation of the electromagnetic valve mechanism according to the first embodiment of the present invention;

FIG. 5 is a graph showing the magnetic force acted on the armature at different displacement in the electromagnetic valve mechanism according to the first embodiment of the present invention;

FIG. 6 is a graph showing the dynamic displacement response of the armature in the electromagnetic valve mechanism according to the first embodiment of the present invention obtained in a dynamic simulation of the armature at a rotation speed of 3000 rpm;

FIGS. 7(*a*)-(*b*) are perspective views showing an electromagnetic valve mechanism according to a second embodiment of the present invention;

FIG. 8 is a perspective view showing an electromagnetic valve mechanism according to a third embodiment of the present invention;

FIG. 9 is a perspective view showing an electromagnetic valve mechanism according to a fourth embodiment of the present invention;

FIG. 10 is a perspective view showing an electromagnetic valve mechanism according to a fifth embodiment of the present invention; and FIG. 11 is a schematic sectional view showing an electromagnetic valve mechanism according to a sixth embodiment of the present invention.

DETAILED DESCRIPTION

The present invention will now be described with some preferred embodiments thereof and with reference to the accompanying drawings.

Figure 1:
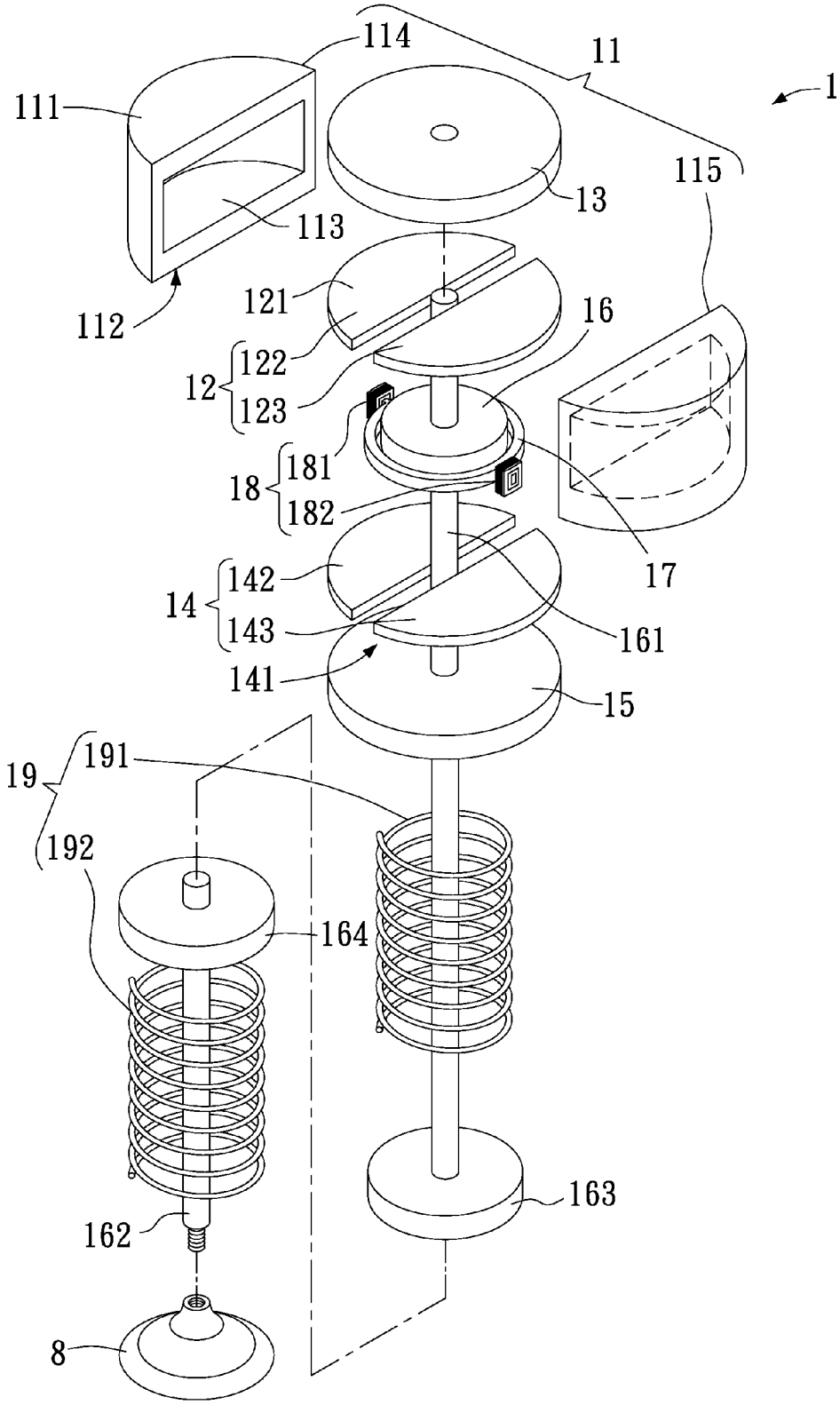
Figure 2:
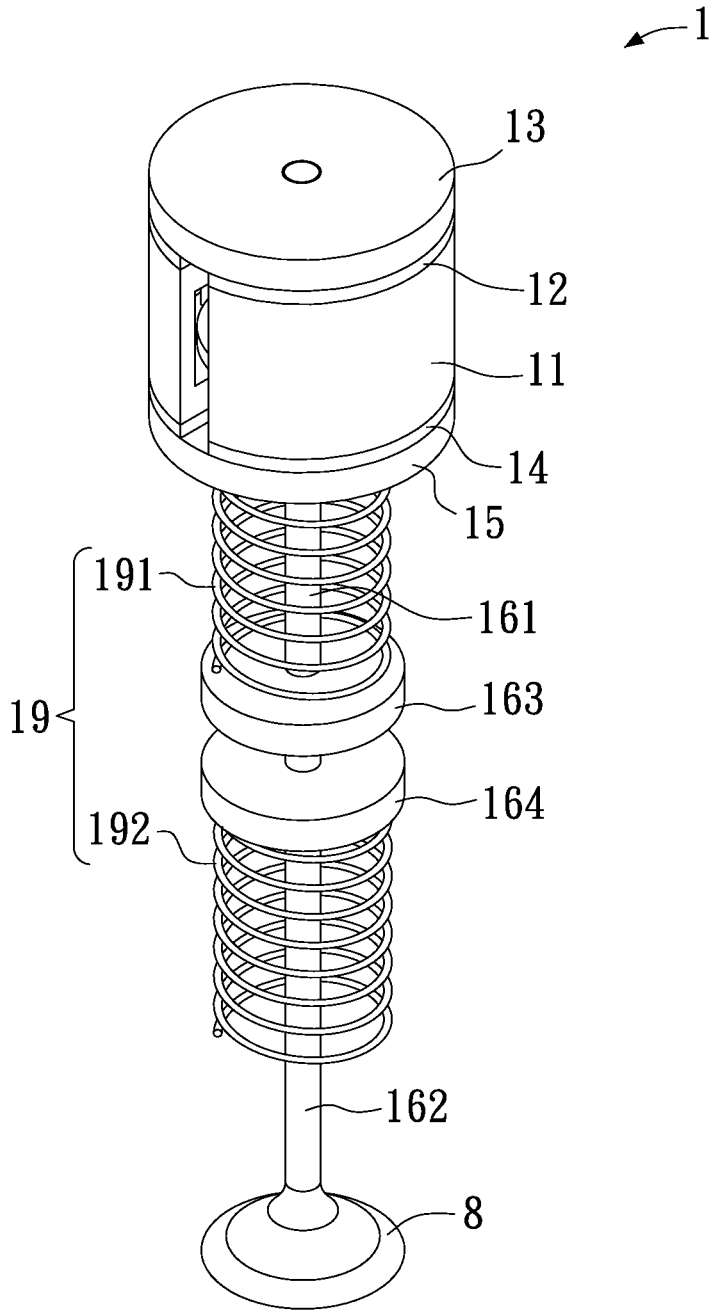
FIG. 2 is an assembled view of FIG. 1.
Figure 3:
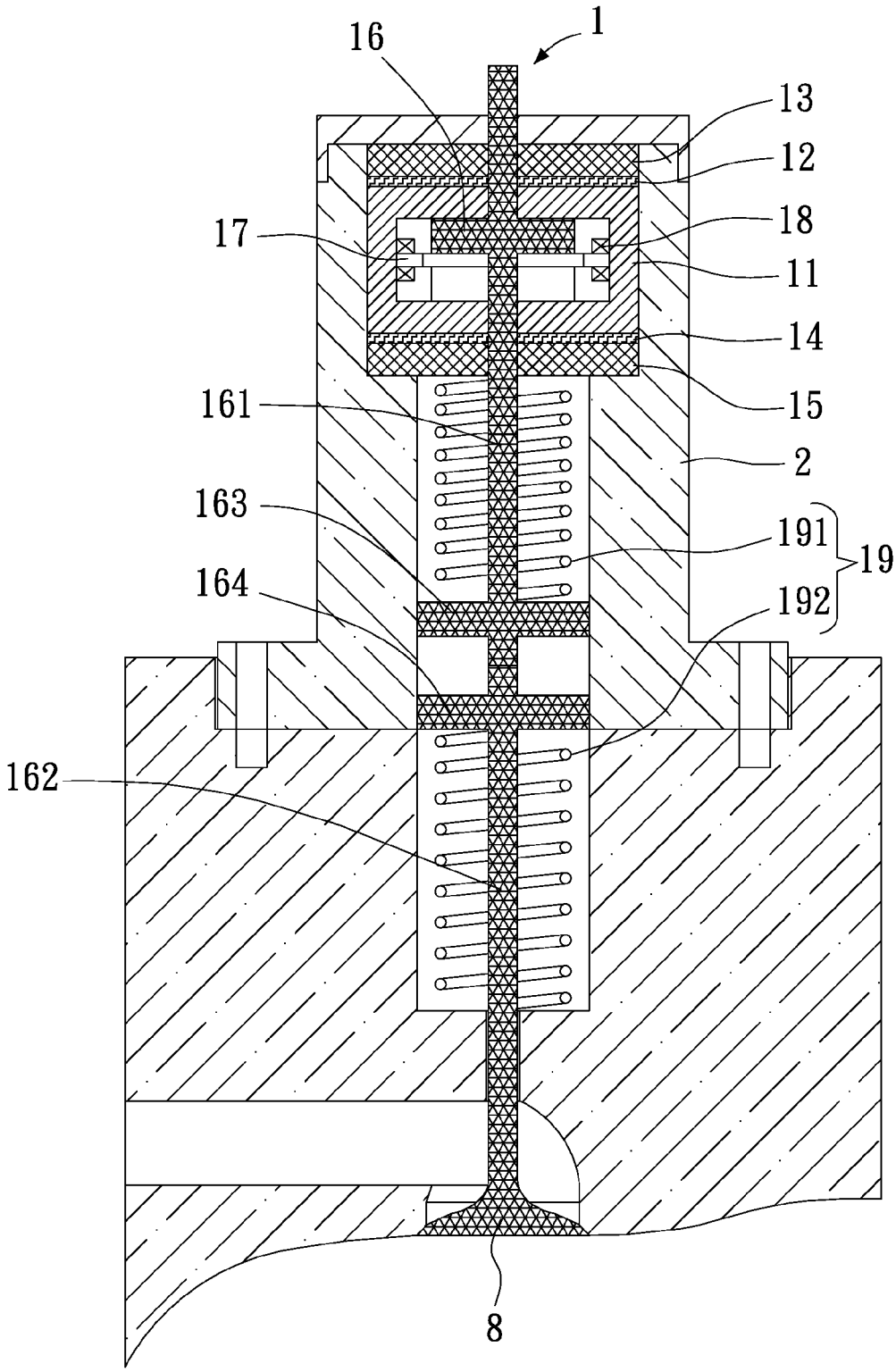
FIG. 3 is an assembled sectional view of the electromagnetic valve mechanism according to the first embodiment of the present invention in use.

Please refer to FIGS. 1 to 6, wherein FIGS. 1 and 2 are exploded and assembled perspective views, respectively, of an electromagnetic valve mechanism 1 according to a first embodiment of the present invention; FIG. 3 is an assembled sectional view showing the electromagnetic valve mechanism 1 in use; FIGS. 4(*a*)-(*f*) show the actuation and operation of the electromagnetic valve mechanism 1; FIG. 5 shows the magnetic force acted on an armature at different displacement in the electromagnetic valve mechanism 1; and FIG. 6 shows the dynamic displacement response of the armature in the electromagnetic valve mechanism 1 obtained in a dynamic simulation of the armature at a rotation speed of 3000 rpm.

As shown, the electromagnetic valve mechanism 1 in the first embodiment of the present invention includes a magnetizable block 11, an upper permanent magnet 12, a magnetizable upper cover 13, a lower permanent magnet 14, a magnetizable lower cover 15, an armature 16, a magnetizable ring 17 with two opposite protrudent rods, an electromagnetic coil unit 18, a spring unit 19, and a valve 8.

The magnetizable block 11 has a top 111 and a bottom 112, and internally defines a chamber 113. The magnetizable block 11 may be formed from a left magnetizable block part 114 and a right magnetizable block part 115 that are spaced from but face toward each other. In this case, the top 111 of the magnetizable block 11 is divided into a left top and a right top, the bottom 112 of the magnetizable block 11 is also divided into a left bottom and a right bottom, and the chamber 113 is also divided into a left chamber and a right chamber. The upper permanent magnet 12 is superposed on the top 111 of the magnetizable block 11 and includes an upper flat surface 121. The magnetizable upper cover 13 is superposed on the upper flat surface 121 of the upper permanent magnet 12. The upper permanent magnet 12 may be formed from a left upper permanent magnet 122 and a right upper permanent magnet 123 that are spaced from but face toward each other. The lower permanent magnet 14 is attached to the bottom 112 of the magnetizable block 11 and includes a lower flat surface 141. The lower permanent magnet 14 may be formed from a left lower permanent magnet 142 and a right lower permanent magnet 143 that are spaced from but face toward each other. The magnetizable lower cover 15 is attached to the lower flat surface 141 of the lower permanent magnet 14. The armature 16 is movably received in the chamber 113 in the magnetizable block 11 and includes an armature stem 161, which downward extends through the magnetizable lower cover 15 to an outer side thereof to connect with a valve stem 162. The magnetizable ring 17 with two opposite protrudent rods is located around the armature 16, and the two opposite protrudent rods are connected to the left and right magnetizable block parts, respectively. The electromagnetic coil unit 18 includes a left electromagnetic coil 181 and a right electromagnetic coil 182 that are separately wound around the two opposite protrudent rods of the magnetizable ring 17. The valve 8 is connected to a lower end of the valve stem 162. The spring unit 19 is disposed around the armature stem 161 and the valve stem 162 with a lower and an upper end of the spring unit 19 pressing against a machine body 2 and the magnetizable lower cover 15, respectively.

As can be seen from FIG. 3, which is an assembled sectional view showing the electromagnetic valve mechanism 1 of the above-described structure being applied in a machine body 2, such as an engine or a compressor.

When the electromagnetic valve mechanism 1 with the above arrangements is in a non-actuated state, the armature 16 thereof might be located at a predetermined position as shown in FIG. 4(*a*). More specifically, the armature 16 is magnetically attracted by the upper permanent magnet 12 to thereby locate at an upper position in the chamber 113. At this point, the electromagnetic valve mechanism 1 is in a fully closed position and the paths of magnetic lines therein are shown in FIG. 4(*a*). To actuate the electromagnetic valve mechanism 1, an instantaneous electric current is applied to the electromagnetic coil unit 18. At this point, as shown in FIG. 4(*b*), the paths of some magnetic lines in the electromagnetic valve mechanism 1 are changed and the force acted by the upper permanent magnet 12 on the armature 16 is reduced. That is, by changing the paths of some magnetic lines, it is able to reduce the magnetic force passing through the armature 16. Meanwhile, the armature 16 is brought by an elastic restoring force of the spring unit 19 to move downward in the chamber 113 toward the lower permanent magnet 14, as shown in FIG. 4(*c*). Then, as shown in FIG. 4(*d*), the armature 16 is magnetically attracted to the lower permanent magnet 14 and the electromagnetic valve mechanism 1 is now in a fully opened position. Similarly, another instantaneous electric current can be then applied to the electromagnetic coil unit 18. At this point, the paths of some magnetic lines in the electromagnetic valve mechanism 1 are changed, as shown in FIG. 4(*e*), and the force acted by the lower permanent magnet 14 on the armature 16 is reduced. Again, by changing the paths of some magnetic lines, it is able to reduce the magnetic force passing through the armature 16. Meanwhile, the armature 16 is brought by an elastic restoring force of the spring unit 19 to move upward in the chamber 113 toward the upper permanent magnet 12, as shown in FIG. 4(*f*). Then, as shown in FIG. 4(*a*), the armature 16 is magnetically attracted to the upper permanent magnet 12 and the electromagnetic valve mechanism 1 is now in a fully closed position again.

Therefore, as described above, by adding two permanent magnets, i.e. the upper and the lower permanents 12, 14, as an aid and using the electromagnetic coil unit 18, it is able to form a bypassed forward secondary magnetic channel in the electromagnetic valve mechanism, and accordingly, enable the electromagnetic valve mechanism to achieve the effects of lowered energy consumption, reduced overall mechanism volume, providing demagnetization-protection for permanent magnets, and enhanced valve performance.

As can be seen in FIG. 1, the spring unit 19 may include an upper spring 191 and a lower spring 192; the armature stem 161 has an upper stop plate 163 provided thereon; and the valve stem 162 has a lower stop plate 164 provided thereon. The upper spring 191 has an upper and a lower end pressing against the magnetizable lower cover 15 and the upper stop plate 163, respectively; and the lower spring 192 has an upper and a lower end pressing against the lower stop plate 164 and the machine body 2, respectively, as shown in FIG. 3. The upper and the lower spring 191, 192 can be configured as extension springs and/or compression springs, depending on an actual manner desired for moving the armature 16. Thus, with the above-described laterally symmetrical mechanism design, it is able to reduce the difference between the forces being acted on the armature 16 when the electromagnetic valve mechanism 1 is in the fully opened and the fully closed position.

Moreover, as can be seen from FIGS. 1 to 3, the magnetizable block 11, the upper permanent magnet 12, the magnetizable upper cover 13, the lower permanent magnet 14, the magnetizable lower cover 15, the armature 16 and the magnetizable ring 17 all are circular in shape. This circular configuration enables further reduction of the volume of the electromagnetic valve mechanism 1. Meanwhile, when the electromagnetic valve mechanism 1 is applied in an engine, it is also possible to improve the problem of uneven wear of the valve caused by collision of the valve with the cylinder head.

In the illustrated first embodiment, the magnetizable ring 17 is received in the chamber 113 in the magnetizable block 11 and is externally located around the armature 16 with the two opposite protrudent rods connected to the left and right magnetizable block parts 114, 115, respectively. Further, the electromagnetic coil unit 18 is wound around the two diametrically opposite protrudent rods of the magnetizable ring 17 and is also located in the chamber 113. However, in other embodiments of the present invention, the types and the positions of the magnetizable ring 17 and the electromagnetic coil unit 18 relative to the chamber 113 can be varied.

Please refer to FIGS. 7(*a*)-(*b*) that are perspective views showing an electromagnetic valve mechanism according to a second embodiment of the present invention. As shown, the second embodiment is generally structurally similar to the first embodiment, except that it includes a magnetizable block 31, an upper permanent magnet 32, a magnetizable upper cover 33, a lower permanent magnet 34, a magnetizable lower cover 35 and a magnetizable ring 36 with two opposite protrudent rods, all of which are square or rectangular in shape. With this structural design, the electromagnetic valve mechanism according to the second embodiment of the present invention can also achieve the same functions and effects as the first embodiment.

FIG. 8 is a perspective view showing an electromagnetic valve mechanism according to a third embodiment of the present invention. As shown, the third embodiment is generally structurally similar to the first and second embodiments, except that it includes a magnetizable ring 41 with two opposite U-shaped protrudent rods being provided on a magnetizable block 42 with two opposite ends of the two U-shaped protrudent rods exposed from the magnetizable block 42, and an electromagnetic coil unit 43 being wound around the two exposed ends of the U-shaped protrudent rods of the magnetizable ring 41 to locate outside the magnetizable block 42. With this structural design, the electromagnetic valve mechanism according to the third embodiment of the present invention can also achieve the same functions and effects as the previous embodiments.

FIG. 9 is a perspective view showing an electromagnetic valve mechanism according to a fourth embodiment of the present invention. As shown, the fourth embodiment is generally structurally similar to the previous embodiments, except that it includes a magnetizable block 51, an upper permanent magnet 52, a magnetizable upper cover 53, a lower permanent magnet 54, a magnetizable lower cover 55, and a magnetic ring 56 with two opposite U-shaped protrudent rods, all of which are square or rectangular in shape. Further, in the fourth embodiment, the magnetizable ring 56 is provided on the magnetizable block 51 with two opposite ends of the two U-shaped protrudent rods exposed from the magnetizable block 51, and an electromagnetic coil unit 57 is wound around the two exposed ends of the two U-shaped protrudent rods of the magnetizable ring 56 to locate outside the magnetizable block 51. With this structural design, the electromagnetic valve mechanism according to the fourth embodiment of the present invention can also achieve the same functions and effects as the previous embodiments.

Please refer to FIG. 10 that is a perspective view showing an electromagnetic valve mechanism according to a fifth embodiment of the present invention. As shown, the fifth embodiment is generally structurally similar to the previous embodiments, except that it includes a magnetizable block 61, an upper permanent magnet 62, a magnetizable upper cover 63, a lower permanent magnet 64, and a magnetizable lower cover 65, all of which are square or rectangular in shape. Further, in the fifth embodiment, there is an electromagnetic coil unit 66 being partially exposed from the magnetizable block 61. With this structural design, the electromagnetic valve mechanism according to the fifth embodiment of the present invention can also achieve the same functions and effects as the previous embodiments.

Please refer to FIG. 11 that is a schematic sectional view showing an electromagnetic valve mechanism 7 according to a sixth embodiment of the present invention. As shown, the sixth embodiment is generally structurally similar to the previous embodiments, except that it includes an armature stem 71 and a reset mechanism 72, such as a solenoid valve, located at a position corresponding to the armature stem 71. In the event the electromagnetic valve mechanism 7 does not return to its default position, such as the fully closed position, after completion of its actuation, the reset mechanism 72 may function to reset the electromagnetic valve mechanism 7 to its default position.

In conclusion, the electromagnetic valve mechanism according to the present invention provides the following advantages:

(1) Overcoming the problem of consuming additional energy for locating the armature: By disposing the two permanent magnets at specific positions, it is able to provide force sufficient for resisting the elastic restoring force of the spring unit when the electromagnetic valve mechanism is in the fully opened or the fully closed position, so that the armature can be controlled to maintain at the fully opened or the fully closed position without consuming additional energy.

(2) Saving the starting current: The armature of the conventional electromagnetic valve mechanism in a non-actuated state is located between the upper and the lower coil in a balanced state. However, with the structural design of the present invention, the armature of the electromagnetic valve mechanism can have an initial position just at the fully closed position. In this manner, the additional starting current for actuating the armature can be saved. Further, the electromagnetic valve mechanism of the present invention is a fail-to-safe design.

(3) Circular mechanism design: The electromagnetic valve mechanism of the present invention can be circular in shape, which largely reduces the volume of the whole mechanism and improves the problem of uneven wear of valve due to collision of the valve with the cylinder head.

(4) Providing a bypassed forward secondary magnetic channel: With the special design and arrangements of dual electromagnetic coils and magnetic channel, it is able to prevent the magnetic lines of the electromagnetic coil unit from passing through the permanent magnets to cause undesired demagnetization of the permanent magnets.

With the above arrangements, the present invention is novel and improved because two permanent magnets are added to the electromagnetic valve mechanism as an aid and two electromagnetic coils are used to thereby form a bypassed forward secondary magnetic channel in the electromagnetic valve mechanism, enabling the electromagnetic valve mechanism to achieve the effects of lowered energy consumption, reduced overall mechanism volume, providing demagnetization-protection for permanent magnets, and enhanced valve performance. The present invention is also industrial valuable because products derived from the present invention would no doubt meet the current market demands.

The present invention has been described with some preferred embodiments thereof and it is understood that many changes and modifications in the described embodiments can be carried out without departing from the scope and the spirit of the invention that is intended to be limited only by the appended claims.

What is claimed is:

1. An electromagnetic valve mechanism, comprising:

a magnetizable block having a top and a bottom, and internally defining a chamber; and the magnetizable block being formed from a left and a right magnetizable block part, which are spaced from but face toward each other;

an upper permanent magnet being superposed on the top of the magnetizable block, and having an upper flat surface; and the upper permanent magnet being formed from a left and a right upper permanent magnet, which are spaced from but face toward each other;

a magnetizable upper cover being superposed on the upper flat surface of the upper permanent magnet;

a lower permanent magnet being attached to the bottom of the magnetizable block, and having a lower flat surface; and the lower permanent magnet being formed from a left and a right lower permanent magnet, which are spaced from but face toward each other;

a magnetizable lower cover being attached to the lower flat surface of the lower permanent magnet;

an armature being movably received in the chamber in the magnetizable block, and including an armature stem, which downward extends through the magnetizable lower cover to an outer side thereof to connect with a valve stem;

a magnetizable ring with two opposite protrudent rods being located around the armature;

an electromagnetic coil unit including a left electromagnetic coil and a right electromagnetic coil that are separately wound around the two opposite protrudent rods of the magnetizable ring;

a valve being connected to a lower end of the valve stem; and a spring unit being disposed around the armature stem and the valve stem with an upper and a lower end of the spring unit pressing against the magnetizable lower cover and a machine body, respectively.

2. The electromagnetic valve mechanism as claimed in claim 1, wherein the magnetizable ring is received in the chamber in the magnetizable block and externally located around the armature, and the two opposite protrudent rods are connected to the left and right magnetizable block parts, respectively; and wherein the electromagnetic coil unit being wound around the two opposite protrudent rods of the magnetizable ring is located in the chamber.

3. The electromagnetic valve mechanism as claimed in claim 1, wherein the magnetizable ring is provided on the magnetizable block and includes two opposite U-shaped protrudent rods with two opposite ends of the U-shaped protrudent rods extended from the magnetizable block; and the electromagnetic coil unit being wound around the two opposite ends of the U-shaped protrudent rods of the magnetizable ring and being exposed from the magnetizable block.

4. The electromagnetic valve mechanism as claimed in claim 1, wherein the spring unit includes an upper spring and a lower spring, the armature stem is provided with an upper stop plate, and the valve stem is provided with a lower stop plate; the upper spring having an upper and a lower end pressing against the magnetizable lower cover and the upper stop plate, respectively; and the lower spring having an upper and a lower end pressing against the lower stop plate and the machine body, respectively.

5. The electromagnetic valve mechanism as claimed in claim 1, wherein the magnetizable block, the upper permanent magnet, the magnetizable upper cover, the lower permanent magnet, the lower magnetizable cover, the armature, and the magnetizable ring with two opposite protrudent rods all are circular in shape.

6. The electromagnetic valve mechanism as claimed in claim 1, wherein the magnetizable block, the upper permanent magnet, the magnetizable upper cover, the lower permanent magnet, the lower magnetizable cover, the armature, and the magnetizable ring with two opposite protrudent rods all are square or rectangular in shape.

7. The electromagnetic valve mechanism as claimed in claim 1, further comprising a reset mechanism being located at a position corresponding to the armature stem.

* * * * *